US006589348B2

(12) United States Patent
Ott

(10) Patent No.: US 6,589,348 B2
(45) Date of Patent: Jul. 8, 2003

(54) METHOD AND APPARATUS FOR CONVEYING ELECTRICALLY CONDUCTIVE PAINTS BETWEEN DIFFERENT VOLTAGE POTENTIALS

(75) Inventor: Winfried Ott, Rodgau (DE)

(73) Assignee: LacTec GmbH Gesellschaft fuer moderne Lackiertechnik, Rodgau (DE)

( * ) Notice: Subject to any disclaimer, the term of this patent is extended or adjusted under 35 U.S.C. 154(b) by 0 days.

(21) Appl. No.: 09/842,611

(22) Filed: Apr. 26, 2001

(65) Prior Publication Data

US 2002/0064601 A1 May 30, 2002

(30) Foreign Application Priority Data

Nov. 28, 2000 (DE) ..... 100 59 041

(51) Int. Cl.[7] ..... B05C 11/10

(52) U.S. Cl. ..... 118/684; 118/692; 118/688; 118/712; 118/602; 118/633

(58) Field of Search ..... 118/626, 633, 118/639, 602, 692, 688, 684, 710, 310, 311, 312; 427/475, 483

(56) References Cited

U.S. PATENT DOCUMENTS

| | | | | |
|---|---|---|---|---|
| 4,774,905 A | * | 10/1988 | Nobis | 118/304 |
| 5,230,842 A | * | 7/1993 | Munde | 118/408 |
| 5,288,525 A | * | 2/1994 | Diana | 118/302 |
| 5,632,816 A | | 5/1997 | Allen et al. | |
| 6,422,491 B1 | | 7/2002 | Bilz et al. | |

FOREIGN PATENT DOCUMENTS

| | | |
|---|---|---|
| DE | 19704573 | 8/1998 |
| DE | 19756488 | 7/1999 |
| DE | 19817377 | 11/1999 |
| DE | 19858397 | 6/2000 |
| DE | 19940542 | 3/2001 |
| DE | 10064065 | 7/2001 |

OTHER PUBLICATIONS

Lichte et al.; U.S. patent application Publication No. 2001/0047755 A1, Publication Date: Dec. 6, 2001, entitled: "Method and Configuration for Transporting Electrically Conductive Paint", cover sheet, 3 sheets of drawings and pp. 1 to 8.

* cited by examiner

*Primary Examiner*—Richard Crispino
*Assistant Examiner*—George R. Koch, III
(74) *Attorney, Agent, or Firm*—W. F. Fasse; W. G. Fasse

(57) ABSTRACT

An electrostatic paint atomizer connected to a discharge station at high voltage is supplied, via an isolating conveying line, with individual divided-off quantities of paint enclosed between two pigs from a loading station at the other end of the conveying line. The paint is conveyed by a transport device supplying a thrust medium (compressed air or insulating liquid) to discharge the paint in the discharge station. A reverse transport device operating with compressed air transports the pigs back to the loading station. The length (L) of the conveying line between the loading and the discharge stations and the length (l) of a divided-off quantity of paint, are dimensioned to provide a sufficiently long isolating path (L-l) to avoid a voltage flashover. A continuous supply of paint is achieved with two parallel conveying lines, through which quantities of paint are metered with an offset from each other.

9 Claims, 8 Drawing Sheets

METHOD AND APPARATUS FOR CONVEYING ELECTRICALLY CONDUCTIVE PAINTS BETWEEN DIFFERENT VOLTAGE POTENTIALS

FIELD OF THE INVENTION

The invention relates to a method for conveying electrically conductive paints from a supply system at ground potential, especially a color changer, to a consumer at high voltage, especially an electrostatic paint atomizer.

BACKGROUND INFORMATION

The electrostatic processing of electrically highly conductive paints, for example water-based paints, makes it necessary to transfer the paint from ground potential to high voltage potential, it being necessary to ensure electrical isolation between the potentials.

For this purpose, various procedures are known and described, for example in U.S. Pat. No. 5,632,816 or DE 197 56 488, where operations are carried out with a paint supply lance which is moved into the paint discharge position through an insulating liquid.

The common factor in the known methods is that they either require very complex control or monitoring functions or cannot be used in connection with automatic quick color-change systems.

SUMMARY OF THE INVENTION

Accordingly, the invention is based on the object of providing a simply structured method which requires comparatively low outlay on control and is also suitable for automatic quick color-change systems.

According to the invention, this object is achieved by individual quantities of paint being divided off and moved at intervals in space and time along a conveying path between the supply system and the consumer, the length of the conveying path exceeding the extent of the individual quantities of paint in the conveying direction by an amount that is sufficient as an isolating path.

The invention also relates to an apparatus for implementing this method, having a conveying line for paint, which is connected into the connection between a grounded supply system, especially a color changer, and a consumer at high voltage, especially an electrostatic atomizer.

To this extent, also, the abovementioned object of the invention applies, namely to provide an apparatus which is constructed comparatively simply, manages with a low outlay on control and can also be used for automatic quick color-change systems.

According to the invention, this apparatus is defined by the fact that the conveying line consists of an insulating material, there are arranged in the conveying line at least one pair of pigs comprising a rear pig and a front pig, the rear end of the conveying line is assigned a loading station for supplying divided-off quantities of paint between the two pigs, the front end of the conveying line is assigned a discharge station for removing the divided-off quantities of paint from the conveying line, a transport device is provided to displace the pair of pigs with an accommodated quantity of paint from the loading station to the discharge station, and a reverse transport device to displace the pair of pigs from the discharge station to the loading station, the length of the conveying line between the loading station and the discharge station and the length of the unit quantities of paint accommodated between the pigs are dimensioned such that the added conveying-line sections upstream and downstream of the unit quantities of paint always form an isolating path of sufficient length between the loading station and the discharge station.

According to the invention, therefore, the paint is conveyed discontinuously in individual quantities, the longitudinal extent, measured in the conveying direction, of the individual units of paint being considerably below the length of the conveying path or the isolating conveying line, so that a sufficient isolating path always remains within the latter. Because of this measure, the individual quantities of paint or units of paint can be transported without difficulty into the high voltage area, for example by means of compressed air or an insulating liquid as a thrust medium, as outlined below using the exemplary embodiment. Since dividing up the quantities of paint does not raise any difficulties either, the method according to the invention and the associated apparatus prove to be fit for the purpose, simple and operationally reliable.

The discontinuous transfer of the individual quantities of paint presupposes at least partial intermediate storage of the paint in the high voltage area, if the consumer is to be supplied continuously. However, such intermediate storage can be avoided if, according to a particularly expedient version, the divided-off quantities of paint are supplied via two conveying paths or through two parallel conveying lines, the discharge of paint being carried out without interruption alternately from the quantities of paint from the one conveying path or conveying line and the other.

BRIEF DESCRIPTION OF THE DRAWINGS

Two exemplary embodiments of the invention will be explained in more detail below using a schematic drawing, in which.

DETAILED DESCRIPTION OF PREFERRED EXAMPLE EMBODIMENTS

Figure 1:
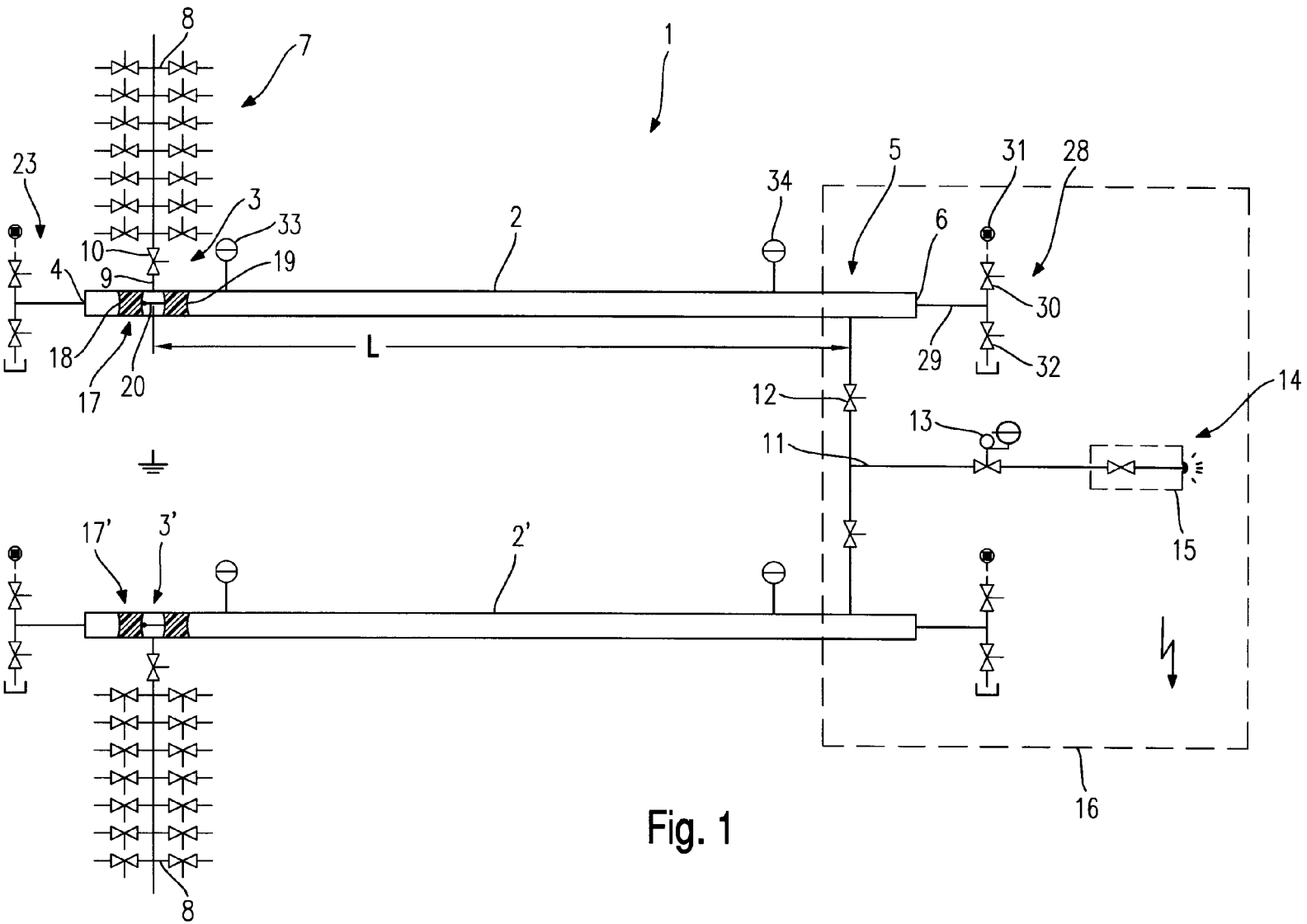
FIGS. 1 to 5 show the same paint conveying apparatus with two parallel conveying lines between a color changer and an electric paint atomizer under high voltage, whereby the individual FIGS. 1, 2, 3, 4 and 5 respectively show successive different operating stages in a method of using the apparatus.

According to FIG. 1, the conveying apparatus 1 comprises a conveying line 2 with a loading station 3 close to the rear end 4 of the line, and a discharge station 5 close to the front end 6 of the line. The conveying line 2 is produced from an electrically insulating material, for example plastic, and has a comparatively great length L between the loading station 3 and the discharge station 5.

A supply system 7 for paint, which is constructed as an automatic color changer 8, is connected to the conveying line 2 via a supply line 9 with a supply valve 10 in the loading station 3.

In the discharge station 5, a discharge line 11 with a discharge valve 12 is connected to the conveying line 2. The discharge line 11 leads via a metering device 13 to a consumer 14, which is formed here by an electrostatic paint atomizer 15. There is high voltage across the latter, so that there is a high voltage area 16, which is indicated dashed and into which the discharge station 5 also falls. In contrast, the supply system 7 and the loading station 3 are at ground potential, as indicated by an appropriate symbol.

Arranged in the conveying line 2 is a pair of pigs 17 including a rear pig 18 and a front pig 19, which can be moved through the line 2 in the longitudinal direction like a piston, but completely fill the cross section of the conveying line 2 and therefore form a dimensionally stable dividing element for the media located on opposite sides in the conveying line 2. The pigs 18 and 19 are held at a minimum distance from each other by a distance piece 20, as FIG. 1 shows. According to FIG. 2, however, the two pigs 18, 19 can assume a greater distance from each other, in order to accommodate between them a specific quantity of paint 21. Such a quantity of paint 21 occupies a length 1 within the conveying line 2. It is important that this length l, and therefore the quantity of paint 21, are selected to be not too high, so that the conveying line 2 still has a sufficient isolating length L-l, which prevents the high voltage from the high voltage area 16 breaking through to the loading station 3.

The quantity of paint 21, together with the pigs 18, 19 enclosing it, form a unit 22 which, by means of a transport device 23 acting through the line 2 in the conveying direction, can be displaced from the loading station 3 to the discharge station 5. For this purpose, a compressed-air line 24 is connected to the rear end 4 of the conveying line 2, is connected via a compressed-air valve 25 to a compressed-air source 26 and is provided with a vent valve 27, which is opened in order to transport the pair of pigs 17 back from the discharge station 5 to the loading station 3.

In order to return the pair of pigs 17 from the discharge station 5 to the loading station 3 in this way, a reverse transport device 28 is also provided, which is connected to the front end 6 of the conveying line 2 and is otherwise constructed like the transport device 23. Accordingly, the reverse transport device 28 comprises a compressed-air line 29 with a compressed-air valve 30, which is connected to a compressed-air source 31 and is provided with a vent valve 32.

Furthermore, a loading sensor 33 is assigned to the conveying line 2 in the area of the loading station 3, and a discharge sensor 34 is assigned to the conveying line 2 in the area of the discharge station 5. These sensors respond to the presence of the pair of pigs 17 or of the unit 22 in the sensor area.

As the figures show, not only is a single conveying line 2 provided but a further, parallel conveying line 2', which is equipped and connected in completely the same way as the conveying line 2, so that a detailed description of one will be omitted, and the same reference symbols with an appended distinguishing prime will be used. The conveying line 2' is connected to the same color changer 8 and to the same common discharge line 11.

In the following text, the mode of operation of the apparatus 1 will be described by using FIGS. 1 to 5:

According to FIG. 1, at the start, the pair of pigs 17 and 17' pushed together are located in the loading station 3 and 3' of the conveying line 2 and 2', respectively. Firstly, the supply valve 10 is opened, until the envisaged quantity of paint 21 has been introduced between the pigs 18, 19 and these have spread out to the length l, as can be seen from FIG. 2. There, the introduction of paint into the interspace in the pair of pigs 17' has also already been started.

Figure 2:
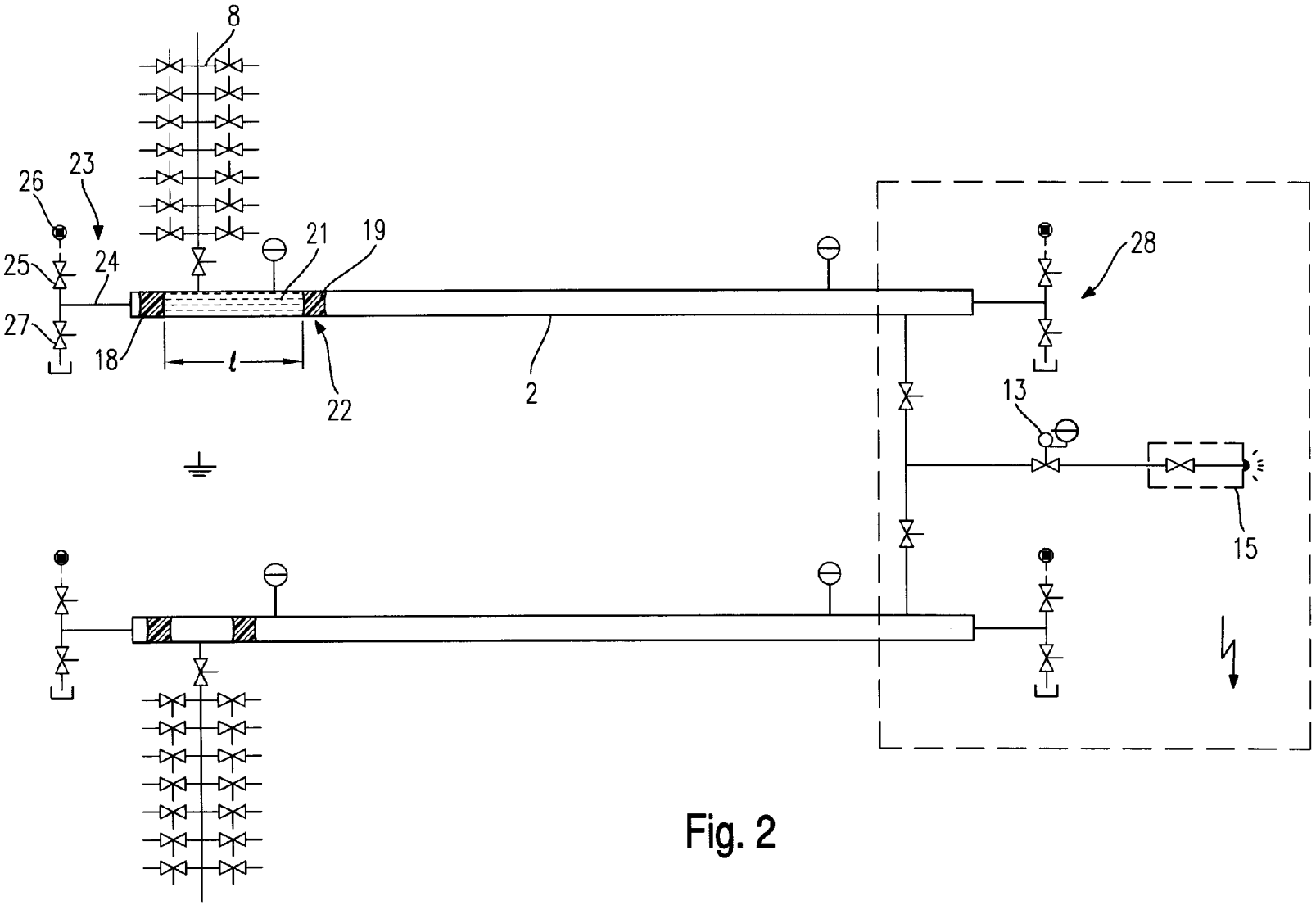
Figure 3:
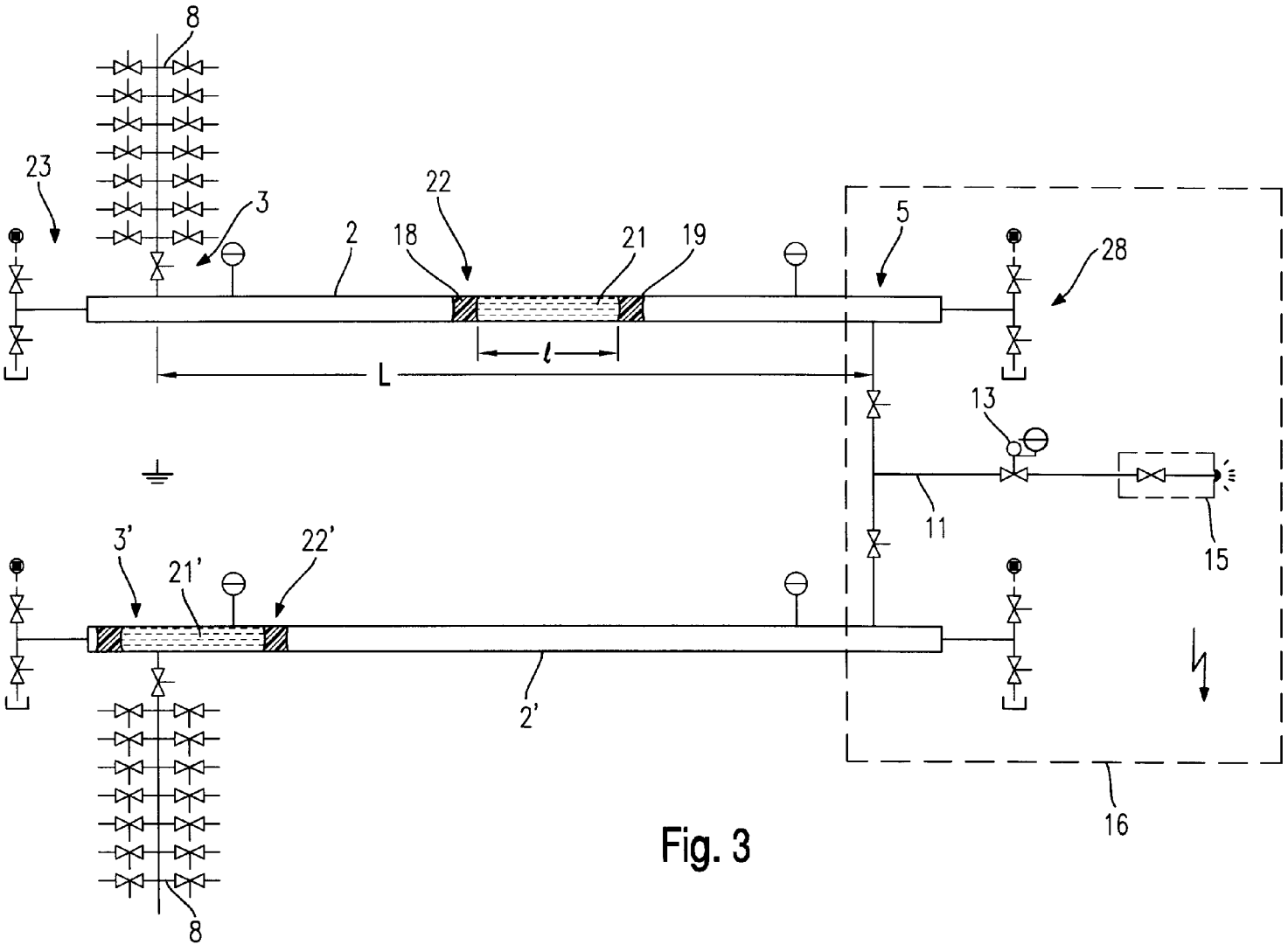

The unit 22 is now moved forward according to FIG. 2, in that by opening the compressed-air valve 25, compressed air is introduced behind the rear pig 18, the vent valve 32 on the discharge side being opened at the same time. FIG. 3 shows the unit 22 with the quantity of liquids 21 at the half way stage, the isolating path L-l which is now present being divided into two isolating paths upstream and downstream of the quantity of liquid 21. At the same time, the unit 22' is being prepared in the conveying line 2' in the loading station 3'.

Figure 4:
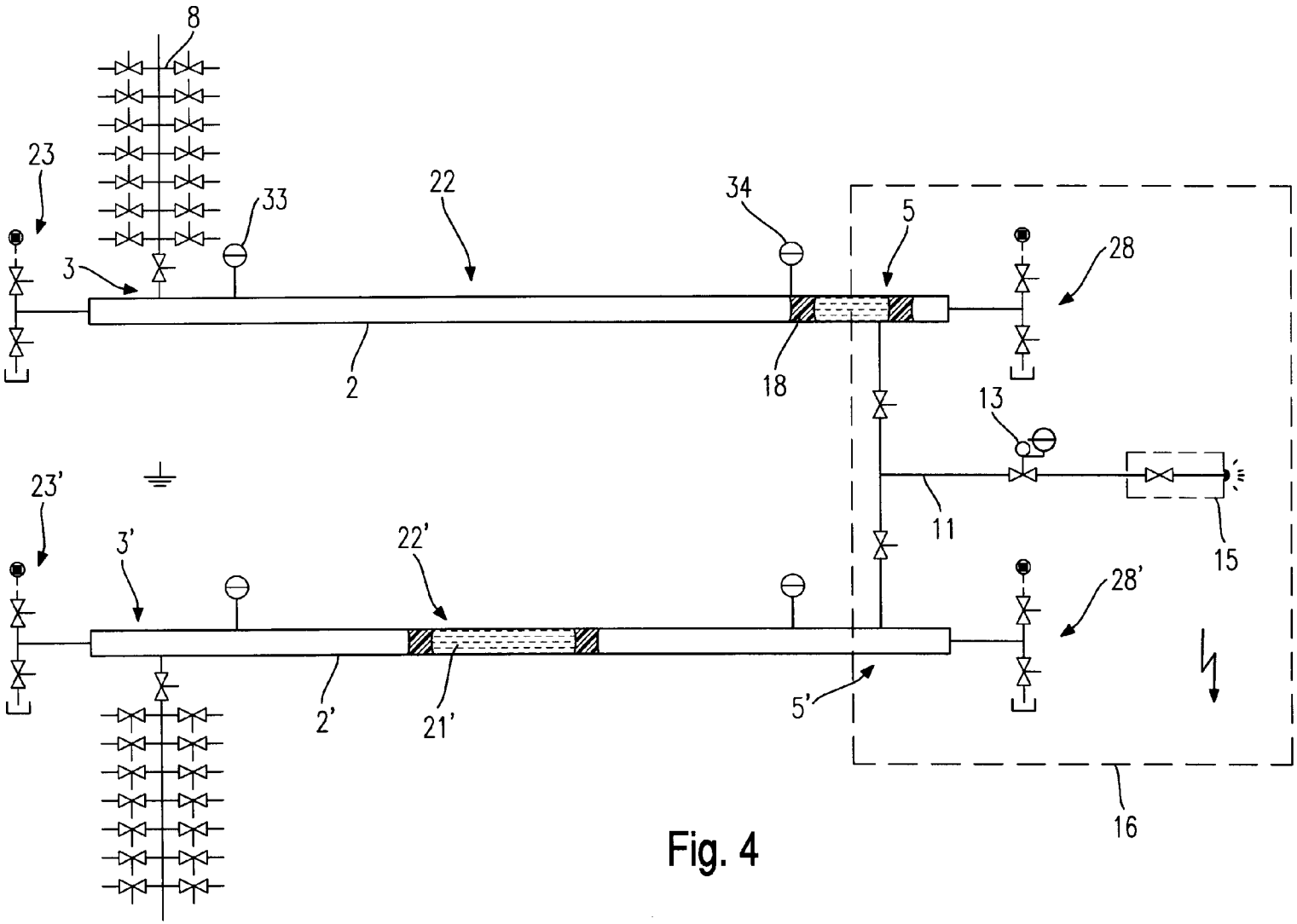

According to FIG. 4, the paint unit 22 has arrived at the discharge station 5, where, as a result of contact, it is itself at high voltage. This arrival at the discharge station 5 is detected by the discharge sensor 34, whereupon the discharge valve 12 is opened, so that the paint flows slowly to the atomizer 15 via the discharge line 11 as prescribed by the metering device 13. According to FIG. 4, part of the quantity of liquid 21 has already been discharged, while the unit 22' with the quantity of liquid 21' is under way to the discharge station 5', for which purpose the transport device 23' has been activated accordingly.

Before the quantity of paint 21 has been discharged completely, apart from a residue which remains between the pigs 18, 19, the unit 22' with the quantity of paint 21' has arrived in the discharge station 5', so that the discharge of paint can be continued without interruption. The discharge sensor 34 detects the end of the action of emptying the unit 22 in accordance with the forward movement of the rear pig 18, which is continued during the discharge of the paint, whereupon the control device closes the discharge valve 12 and opens the discharge valve 12', so that the atomizer 15 then continues to be supplied from the quantity of paint 21'.

Figure 5:
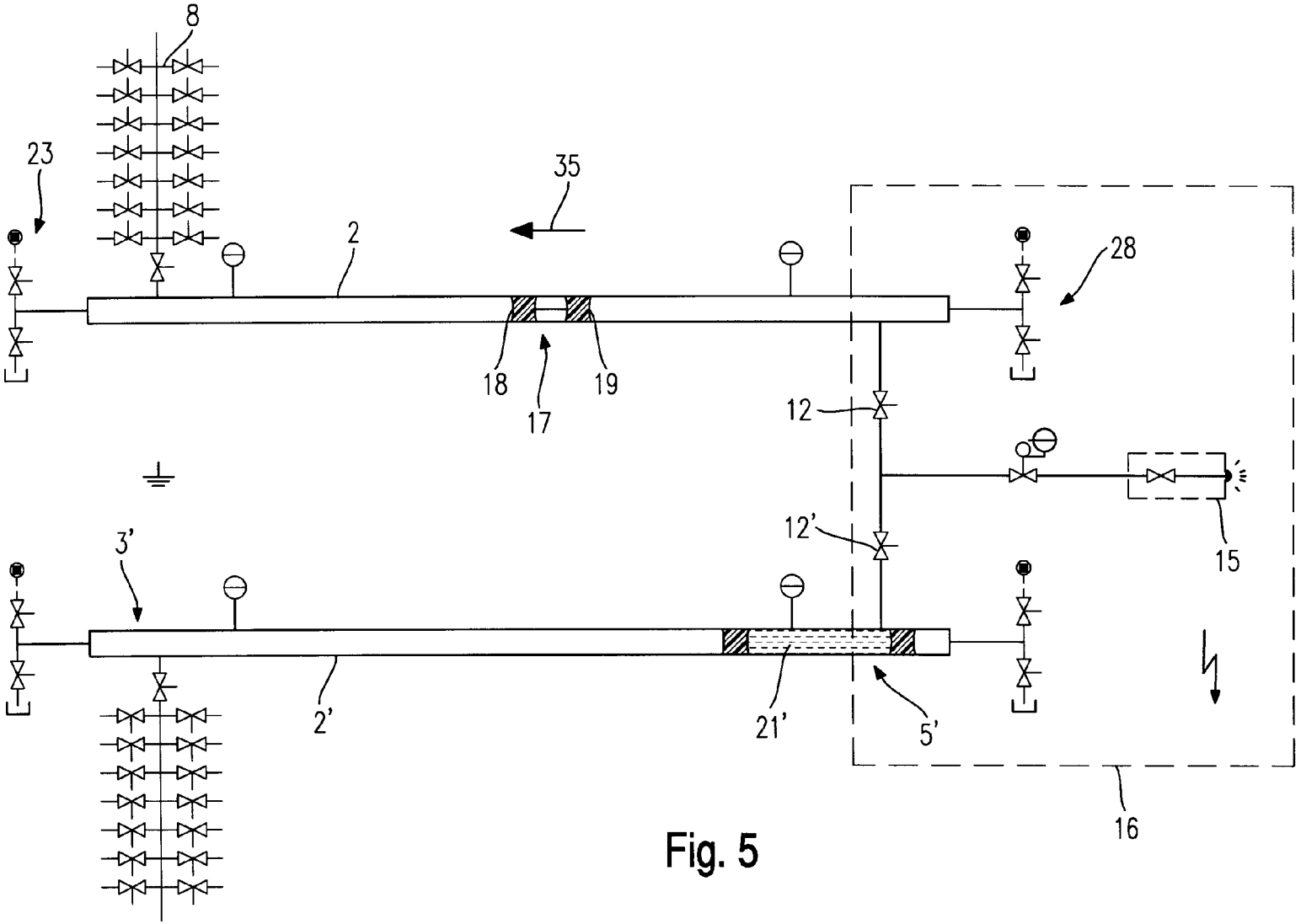

The pair of pigs 17 is then moved back from the discharge station 5 into the loading station 3, as indicated by the arrow 35 in FIG. 5. For this purpose, on the transport device 23 the compressed-air valve 25 is closed and the vent valve 27 is opened, while, conversely, on the reverse transport device 28 the compressed-air valve 30 is opened and the vent valve 32 is closed.

After the arrival of the pair of pigs 17 in the loading station 3, which is detected by the loading sensor 33, with regard to the conveying line 2, the state as illustrated in FIG. 1 has been reached again. The procedure already described is repeated, in which a further quantity of paint 21 is introduced in between the pigs 18 and 19 by a limited opening of the supply valve 10, whereupon the transport to the discharge station 5 is again carried out in the manner described. In this case, the further quantity of paint 21 likewise arrives at the discharge station 5 before the quantity of paint 21' in the discharge station 5' has been discharged completely.

Figure 6:
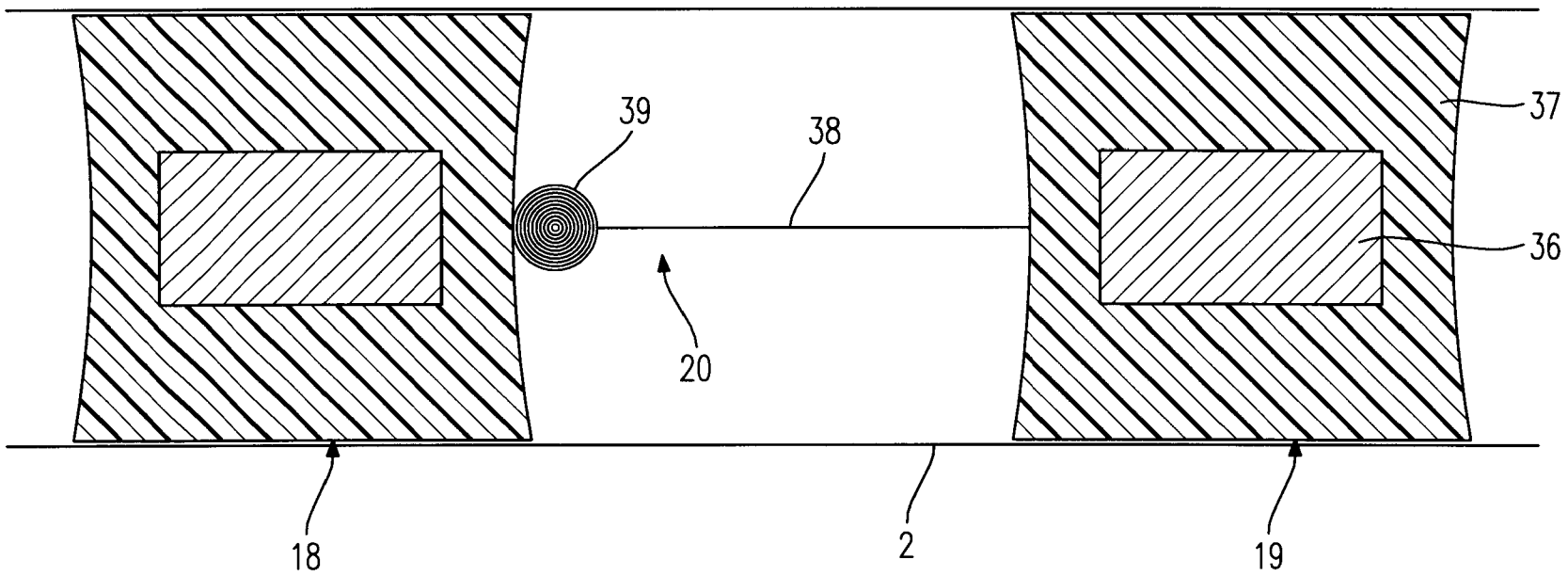
FIG. 6 shows an enlarged illustration of a pair of pigs used in the apparatus and having a distance piece located between them.

FIG. 6 shows that the two pigs 18 and 19 are each constructed in the same way and comprise a core 36 with a covering 37 made of a plastic. The distance piece 20 is formed by a rod 38 projecting from the pig 19 concentrically with the conveying line 2 and having a rounded head piece 39. The distance piece 20 forms a spacer, which prevents the pigs 18 and 19 striking each other and sticking together when they are forced back. In addition, in the loading station 3, the distance piece 20 always ensures a distance between the two pigs 18, 19 which is sufficient for the filling of the interspace.

Figure 7:
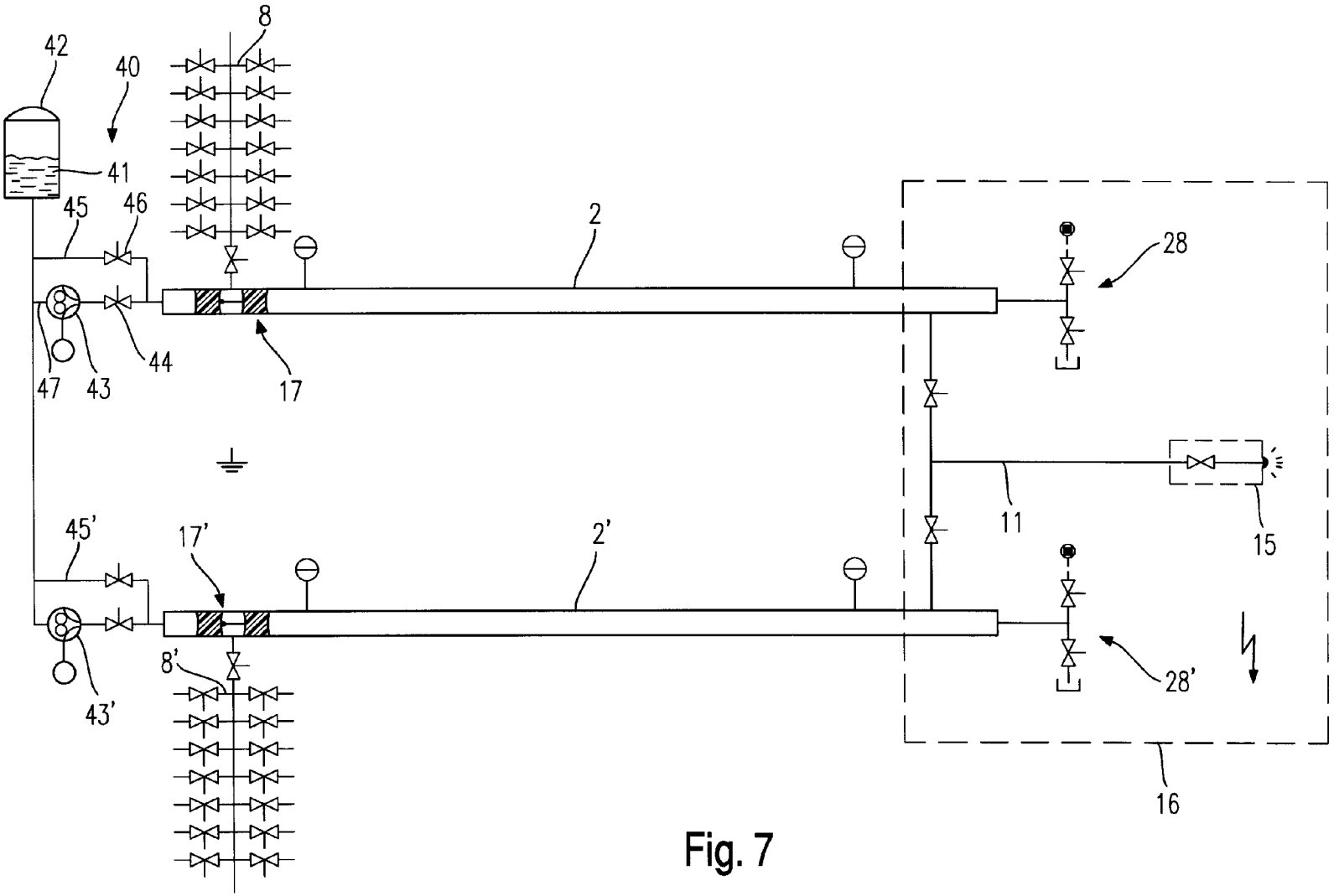
FIG. 7 shows an illustration corresponding to FIG. 1 of a modified apparatus, in which an insulating liquid instead of compressed air is used as a thrust medium.

The apparatus according to FIG. 7 largely corresponds to the illustration in FIG. 1. However, instead of the transport device 23, a modified transport device 40 and 40' is provided, which operates not with compressed air but with an insulating liquid 41, for which a storage container 42 is provided. The latter is connected, via a line 47, to a metering conveying device, which may be a metering pump 43 or a geared pump, and via a delivery valve 44 to the rear end 4 of the conveying line 2. There is a further connection via a return line 45 with a bypass valve 46, which is connected in parallel with the metering pump 43 and the delivery valve 44.

In order to transport the unit 22 from the loading station 3 to the discharge station 5, the metering pump 43 is operated with the delivery valve 44 open and the bypass valve 46 closed, and is switched off only after the paint unit 22 has arrived in the discharge station and after the quantity of paint 21 has been discharged completely, whereupon the delivery valve 44 and the discharge valve 12 are closed and the bypass valve 46 is opened. If, then, the pair of pigs 17 is forced back by means of compressed air into the loading station 3 in the manner described by actuating the reverse transport device 28, the insulating liquid 41 is also forced back again from the conveying line 2 into the storage container 42.

Since, in this design, the quantity of paint 21 is discharged in the discharge station 5 to the extent to which the metering pump 43 delivers insulating liquid, it is possible to dispense with a metering device 13 in the high voltage area 16, which proves to be an advantage.

Figure 8:
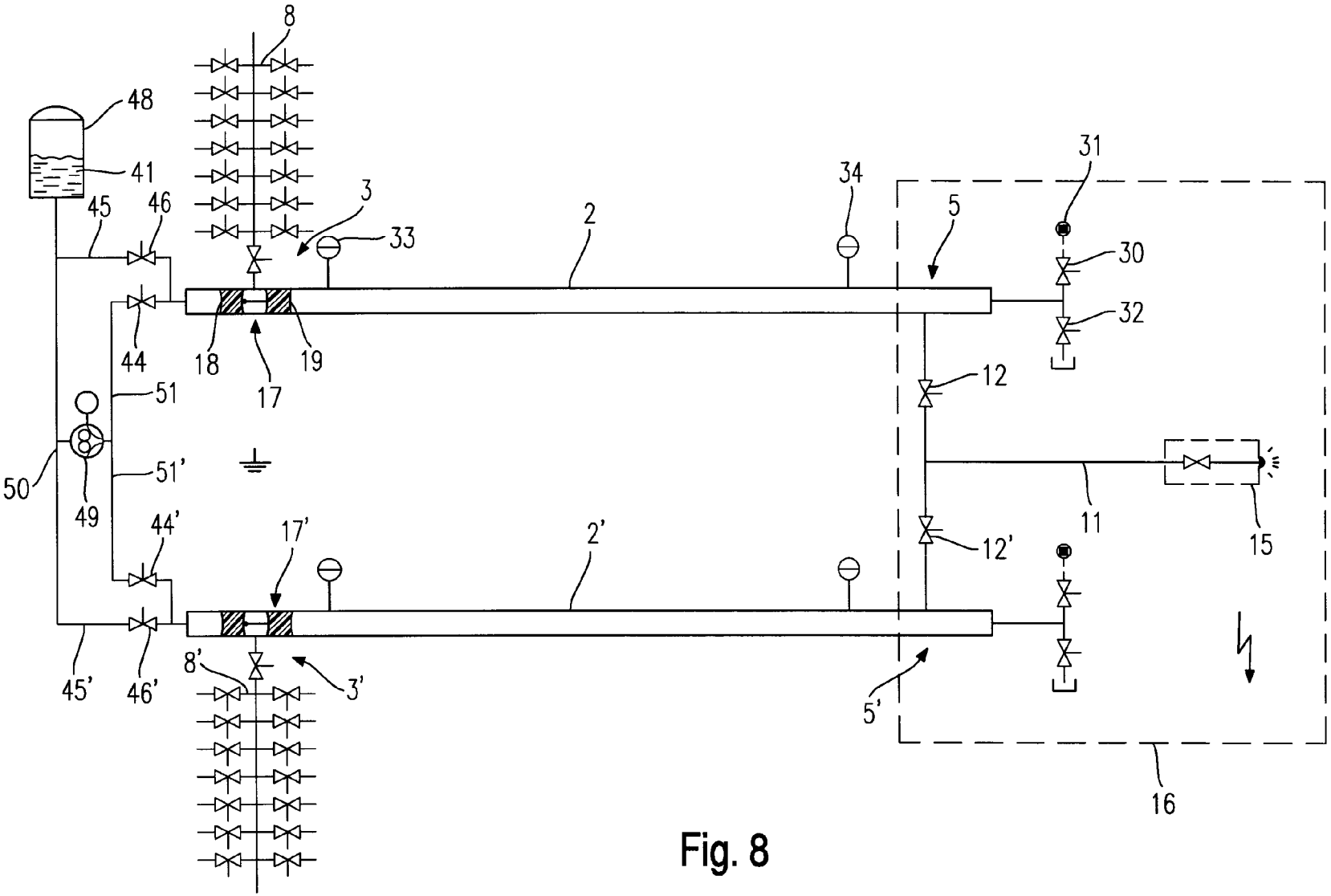
FIG. 8 shows an apparatus which is simplified with respect to FIG. 7.

This advantage is opposed by the disadvantage that the apparatus according to FIG. 7 requires two metering devices 43 and 43', and that the metering device provided for the metered discharge of the quantities of paint 21 and 21' from the discharge station 5, 5' also effects the transport of the quantities of paint from the loading station 3 to the discharge station 5, where metered and slow displacement does not occur. In this regard, the design according to FIG. 8 is advantageous, in which a pressure reservoir 48 for the insulating liquid 41 is provided, under a pressure of, for example, 2 to 5 bar. A common metering pump 49 associated with the two conveying lines 2, 2' is connected via a connecting line 50 to the pressure reservoir 48 and, via separate pressure lines 51 and 51' each having a delivery valve 44, 44', to the rear ends of the conveying lines 2, 2'. A return line 45, 45' with a bypass valve 46, 46' leads from each conveying line 2, 2 to the connecting line 50 and therefore back to the pressure reservoir 48.

The mode of operation of this apparatus according to FIG. 8 is as follows: after a paint unit 22 has been put in between the pair of pigs 17, the bypass valve 46 and the vent valve 32 are opened, so that the pressure of, for example, 2 to 5 bar acting on the insulating liquid 41 transports the paint unit 22 forward from the loading station 3 to the discharge station 5.

Following the arrival of the paint unit 22 in the discharge station 5 and the corresponding report from the sensor 34, the valves 46 and 32 are closed and the valves 44 and 12 are opened, and therefore the metering pump 49 is made capable of delivering the paint from the interspace between the pigs to the atomizer 15 by advancing the rear pig 18 in a metered manner.

While the metering pump 49 is metering the paint out of the conveying line 2 to the atomizer 15, a quantity of paint 21' in the line 2' is being conveyed forward in the prescribed manner by opening the valves 46' and 32'. In order to return the pair of pigs 17 from the discharge station 5 to the loading station 3, the valves 44 and 32 are closed and the valves 46 and 30 are opened, as a result of which not only is the pair of pigs 17 moved back, but in addition the insulating liquid is forced back out of the conveying line 2 into the pressure reservoir 48 again. In a corresponding way, the pair of pigs 17' in the conveying line 2' is also returned.

This procedure permits particularly economical operation.

What is claimed is:

1. An apparatus for supplying electrically conductive paint, comprising:

a paint supply system that is electrically grounded to a ground potential, and that supplies an electrically conductive paint;

a paint discharge arrangement that includes a paint discharging consumer, and that is energized to a high voltage potential above said ground potential;

a first paint conveying line that consists of an electrically insulating material, and that has a rear end comprising a paint loading station connected to said paint supply system and a front end comprising a paint unloading station connected to said paint discharge arrangement;

a rear pig and a front pig received in said paint conveying line, with a spacing distance between said rear pig and said front pig, and with said rear pig closer to said rear end and said front pig closer to said front end of said paint conveying line;

a quantity of said electrically conductive paint that has been supplied from said paint supply system into said paint loading station of said paint conveying line, and that is received in said spacing distance between said rear pig and said front pig in said paint conveying line;

a forward transport arrangement that is connected to said rear end of said paint conveying line and that selectively supplies a forward transport medium into said paint conveying line to selectively transport said rear pig and said front pig and said quantity of said paint received therebetween from said paint loading station to said paint unloading station;

a reverse transport arrangement that is connected to said front end of said paint conveying line and that selectively supplies a reverse transport medium into said paint conveying line to selectively transport said front pig and said rear pig from said paint unloading station to said paint loading station; and a control arrangement comprising at least one rear sensor that is arranged adjacent to said paint loading station and that senses and responds to at least one of said front pig and said rear pig moving past said at least one rear sensor;

wherein:

said quantity of said paint received between said rear pig and said front pig in said receiving line defines said spacing distance between said front pig and said rear pig;

said paint conveying line has a total length between said paint loading station and said paint unloading station; and said total length of said paint conveying line and said quantity of said paint are dimensioned relative to each other such that said total length of said paint conveying line minus said spacing distance between said front pig and said rear pig equals a remaining isolating path length sufficient to electrically insulate said paint loading station at said ground potential from said paint unloading station at said high voltage potential.

2. The apparatus according to claim 1, wherein said paint supply system comprises a color changer, and said paint discharging consumer comprises an electrostatic paint atomizer.

3. The apparatus according to claim 1, wherein said control arrangement further comprises at least one front sensor that is arranged adjacent to said paint unloading station and that senses and responds to at least one of said front pig and said rear pig moving past said at least one front sensor.

4. The apparatus according to claim 1, further comprising a spacer member arranged between said front pig and said rear pig, to prevent direct contact of said front pig and said rear pig, and to maintain at least a minimum of said spacing distance.

5. The apparatus according to claim 1, wherein said forward transport arrangement comprises a first compressed air line supplying compressed air as said forward transport medium, a first control valve connected between said first compressed air line and said rear end of said paint conveying line, and a first vent valve connected to said rear end of said paint conveying line, and wherein said reverse transport arrangement comprises a second compressed air line supplying compressed air as said reverse transport medium, a second control valve connected between said second compressed air line and said front end of said paint conveying line, and a second vent valve connected to said front end of said paint conveying line.

6. The apparatus according to claim 1, wherein said forward transport arrangement comprises a storage container containing an electrically insulating liquid as said forward transport medium, a forward feed line and a return line connected parallel to each other between said storage container and said rear end of said paint conveying line, a metering pump interposed in said forward feed line, and a return control valve interposed in said return line.

7. The apparatus according to claim 1, further comprising a second paint conveying line connected parallel to said first paint conveying line between said paint supply system and said paint discharge arrangement, a second front pig and a second rear pig received in said second paint conveying line, and a second quantity of said paint received between said second front pig and said second rear pig in said second paint conveying line at a location offset, between said paint supply system and said paint discharge arrangement, relative to said quantity of paint between said front pig and said rear pig in said first paint conveying line, while maintaining said electrical insulating of said paint loading station at said ground potential from said paint unloading station at said high voltage potential.

8. The apparatus according to claim 7, wherein said forward transport arrangement comprises a common pressure reservoir containing a pressurized electrically insulating liquid as said forward transport medium, a metering pump with an inlet connected to said pressure reservoir and an outlet connected through two control valves respectively to said first and second paint conveying lines, a first bypass line that has a first bypass valve therein and that is connected between said first paint conveying line and said pressure reservoir while bypassing said metering pump, and a second bypass line that has a second bypass valve therein and that is connected between said second paint conveying line and said pressure reservoir while bypassing said metering pump.

9. The apparatus according to claim 1, wherein said paint discharge arrangement further comprises a metering device connected between said front end of said paint conveying line and said paint discharging consumer.

* * * * *